US008827425B2

(12) United States Patent
Sugahara et al.

(10) Patent No.: US 8,827,425 B2
(45) Date of Patent: Sep. 9, 2014

(54) LIQUID DROPLET JETTING APPARATUS

(71) Applicant: Brother Kogyo Kabushiki Kaisha, Aichi-Ken (JP)

(72) Inventors: Hiroto Sugahara, Aichi-Ken (JP); Shuhei Hiwada, Aichi-Ken (JP)

(73) Assignee: Brother Kogyo kabushiki Kaisha, Aichi-ken (JP)

( * ) Notice: Subject to any disclaimer, the term of this patent is extended or adjusted under 35 U.S.C. 154(b) by 79 days.

(21) Appl. No.: 13/627,116

(22) Filed: Sep. 26, 2012

(65) Prior Publication Data

US 2013/0201230 A1 Aug. 8, 2013

(30) Foreign Application Priority Data

Feb. 7, 2012 (JP) ..... 2012-024003

(51) Int. Cl.
*B41J 2/14* (2006.01)

(52) U.S. Cl.
USPC ..... 347/50; 347/6; 347/93

(58) Field of Classification Search
USPC ..... 347/5, 6, 9, 14, 50, 93
See application file for complete search history.

(56) References Cited

U.S. PATENT DOCUMENTS

| | | | | |
|---|---|---|---|---|
| 4,183,029 | A * | 1/1980 | Isayama et al. | 347/93 |
| 7,837,301 | B2 * | 11/2010 | Kubo | 347/50 |
| 2005/0179736 | A1 | 8/2005 | Mataki | |
| 2009/0168047 | A1 | 7/2009 | Sugahara | |

FOREIGN PATENT DOCUMENTS

| | | |
|---|---|---|
| JP | 3164262 | 7/1991 |
| JP | 9183232 | 7/1997 |
| JP | 2001-180001 | 7/2001 |
| JP | 2004-142198 | 5/2004 |
| JP | 2005-262873 | 9/2005 |
| JP | 2009-162600 | 7/2009 |

* cited by examiner

*Primary Examiner* — Lam S Nguyen
(74) *Attorney, Agent, or Firm* — Frommer Lawrence & Haug LLP

(57) ABSTRACT

There is provided a liquid droplet jetting apparatus configured to jet liquid droplets onto an object, including:
a channel member in which a nozzle for jetting the liquid droplets and a liquid channel communicating with the nozzle are formed; an energy conversion element which is configured to apply a jetting energy to the liquid in the nozzle; a drive unit which is configured to supply a driving signal to the energy conversion element; a flow detecting sensor which is configured to detect a liquid flow inside the liquid channel; and a cabling member which includes a drive line connected to the energy conversion element, and a signal output line connected to the flow detecting sensor to transmit a detection signal corresponding to the liquid flow inside the liquid channel output from the flow detecting sensor.

13 Claims, 12 Drawing Sheets

LIQUID DROPLET JETTING APPARATUS

CROSS REFERENCE TO RELATED APPLICATION

The present invention claims priority from Japanese Patent Application No. 2012-024003, filed on Feb. 7, 2012, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

There is known a liquid droplet jetting apparatus which jets liquid droplets from nozzles, and which includes a sensor configured to detect a flow velocity of a liquid flowing in a liquid channel including nozzles.

For instance, an ink-jet printer which has a print head of an ink-jet type, which includes a plurality of nozzles through which droplets of ink are jetted has hitherto been known. A coil is connected to a liquid channel which is connected to an opening of each nozzle of the print head. Moreover, when an ink flows through the liquid channel, an electric voltage corresponding to a flow velocity of the ink flowing through the liquid channel is generated in the coil. In a case in which liquid droplets are jetted from the opening of the nozzle, a flow of ink is generated inside the liquid channel, and in a case in which liquid droplets are not jetted, no flow of ink is generated inside the liquid channel. Consequently, it is possible to distinguish a jetting condition (whether or not there is a jetting defect) of each nozzle based on a voltage signal which is generated in the coil corresponding to the flow velocity of the ink inside the liquid channel.

SUMMARY OF THE INVENTION

In the abovementioned ink-jet printer, the voltage signal corresponding to the flow velocity of the liquid is output from the coil, and the jetting condition of the nozzle is judged according to the output voltage signal. For the abovementioned ink-jet printer, a cabling structure for outputting the voltage signal from the coil has not heretofore been known. However, according to findings of inventors of the present teaching, it has been considered to be necessary to draw a cabling member such as a flexible circuit board for outputting the voltage signal from the coil provided to each nozzle up to a substrate on which a circuit etc. for making a judgment of the jetting condition is mounted. However, providing a dedicated cabling member only for outputting a signal from the coil leads to complicating the cabling structure of the head, and to an increase in cost.

An object of the present teaching is to provide a liquid droplet jetting apparatus in which, it is possible to draw a line for outputting a detection signal from a sensor which detects a flow of a liquid in a liquid channel, without adding a dedicated cabling member.

According to an aspect of the present invention, there is provided a liquid droplet jetting apparatus configured to jet liquid droplets onto an object, including:

a channel member in which a nozzle for jetting the liquid droplets and a liquid channel communicating with the nozzle are formed;

an energy conversion element which is configured to apply a jetting energy to the liquid in the nozzle;

a drive unit which is configured to supply a driving signal to the energy conversion element;

a flow detecting sensor which is configured to detect a liquid flow inside the liquid channel; and a cabling member which includes a drive line connected to the energy conversion element, and a signal output line connected to the flow detecting sensor to transmit a detection signal, corresponding to the liquid flow inside the liquid channel output from the flow detecting sensor.

In this case, the signal output line of the flow detecting sensor which is configured to detect the flow of liquid inside the liquid channel is formed in the cabling member which is used for supplying the driving signal to the energy conversion element from the drive unit. In other words, since the cabling member is shared by the energy conversion element and the flow detecting sensor, it is not necessary to provide a dedicated cabling member for drawing around the flow detecting sensor.

DETAILED DESCRIPTION OF THE PREFERRED EMBODIMENTS

Next, an embodiment of the present teaching will be described below. The embodiment is an example in which, the present invention is applied to an ink-jet printer including an ink-jet head which jets droplets of ink onto a recording paper.

Figure 1:
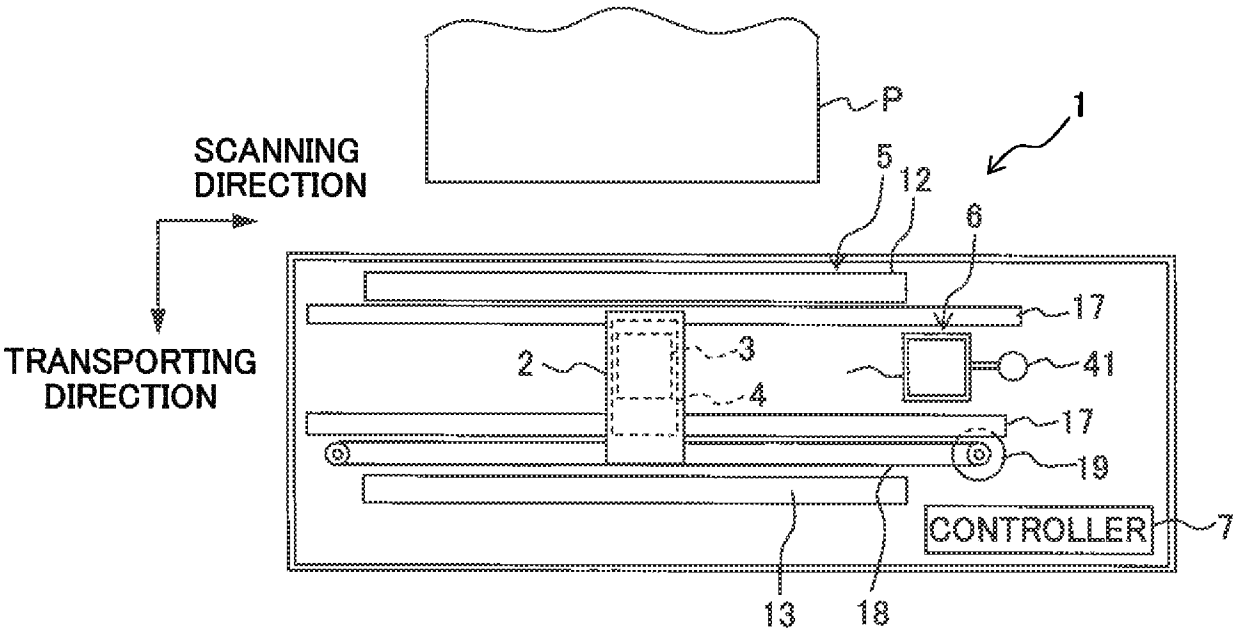
FIG. 1 is a schematic plan view of an ink-jet printer according to an embodiment of the present invention.

To start with, a schematic structure of an ink-jet printer (liquid droplet jetting apparatus) 1 according to the embodiment will be described below. As shown in FIG. 1, the ink-jet printer 1 includes a carriage 2 which is capable of reciprocating along a predetermined scanning direction (left-right direction in FIG. 1), an ink-jet head 3 and a sub tank 4 which are mounted on the carriage 2, a transporting mechanism 5 which transports a recording paper P in a transporting direction which is orthogonal to the scanning direction, a purge mechanism 6 which restores a jetting performance of the ink-jet head 3, and a control unit 7 which controls an operation of each section of the ink-jet printer 1. A vertical direction (transporting direction) in FIG. 1 is defined as a front-rear direction, a horizontal direction (scanning direction) in FIG.

1 is defined as a left-right direction, and a direction perpendicular to a paper surface in FIG. 1 is defined as a up-down direction (a frontward side of the paper surface is an upper side), and in the following description, directions will be described by using appropriately, terms such as front-rear, left-right, and up-down.

The carriage 2 is configured to be reciprocatable along two guide shafts 17 extending parallel to the left-right direction. Moreover, an endless belt 18 is linked to the carriage 2, and when the endless belt 18 is driven to run by a carriage driving motor 19, the carriage 2 moves in the left-right direction (scanning direction) with the running of the endless belt 18.

The ink-jet head 3 and the sub tank 4 are mounted on the carriage 2. The sub tank 4 is shown in a cross-section in FIG. 2. A plurality of nozzles 22 (refer to FIGS. 3, 4, and 5) each jetting droplets of an ink is formed in the ink-jet head 3. The ink-jet head 3 is arranged such that an ink jetting surface in which the plurality of nozzles 22 open is directed downward. Details of a structure of the ink-jet head 3 will be described later.

Figure 2:
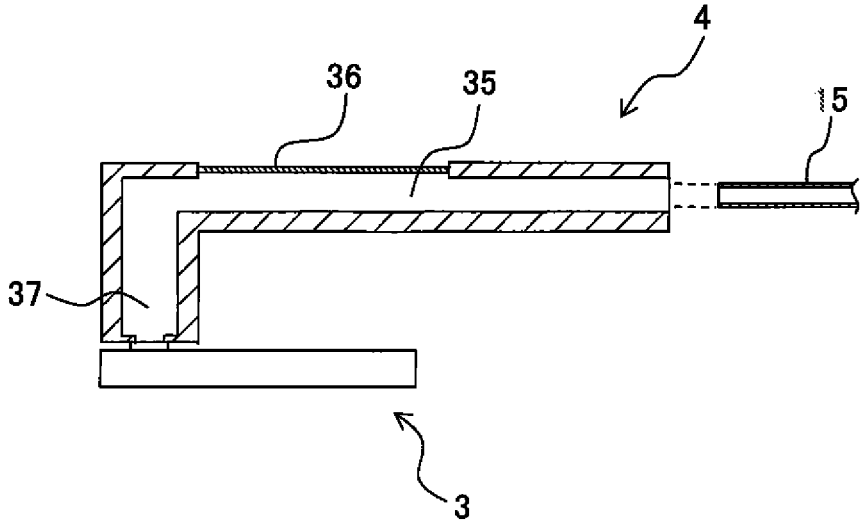
FIG. 2 is a diagram when an ink-jet head and a sub tank are viewed from a scanning direction in FIG. 1.

As shown in FIG. 2, the sub tank 4 is arranged at an upper side of the ink-jet head 3. A damper chamber 35 is formed inside the sub tank 4. The damper chamber 35 has a shape spread along a horizontal plane, and a damper film 36 which is formed by a flexible film is provided to an upper-wall portion of the damper chamber 35. The damper chamber 35 is connected to the ink-jet head 3 via a communicating channel 37, and is also connected to an ink cartridge which is not shown in the diagram, via a tube 15. The damper chamber 35 temporarily stores an ink supplied through the tube 15, and attenuates a pressure fluctuation of the ink to be supplied to the ink-jet head 3.

As shown in FIG. 1, the transporting mechanism 5 has two transporting rollers 12 and 13 arranged at an upstream side and a downstream side of the transporting direction of the ink-jet head 3. A driving force of one transporting motor 14 shown in FIG. 17 is transmitted to the two transporting rollers 12 and 13, and the two transporting rollers 12 and 13 are driven to be rotated in synchronization. The recording paper P is transported to the ink-jet head 3 in the transporting direction by the two transporting rollers 12 and 13.

In the ink-jet printer 1, while the ink-jet head 3 is reciprocating in the scanning direction (left-right direction in FIG. 1), ink droplets are jetted onto the recording paper P, and the recording paper P is transported in the transporting direction (frontward direction in FIG. 1) by the two transporting rollers 12 and 13. Accordingly, the ink-jet printer 1 prints a desired image and characters on the recording paper P.

Figure 7:
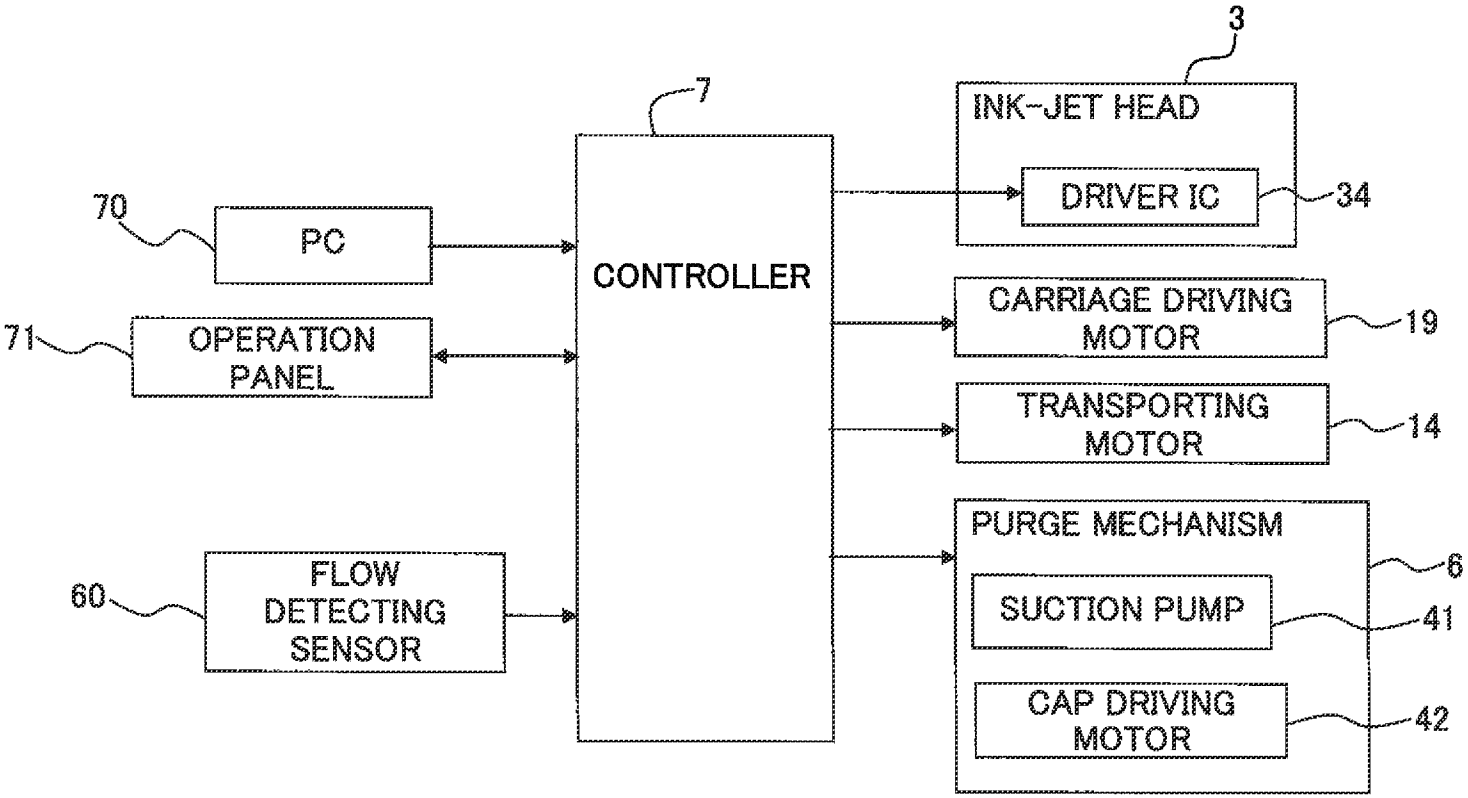
FIG. 7 is a block diagram showing schematically an electrical structure of the printer.

When a jetting defect occurs in the nozzle 22 of the ink-jet head 3, the purge mechanism 6 restores the jetting performance of the nozzle 22 by making the ink discharge from the plurality of nozzles 22. The purge mechanism 6 is arranged at a position at an outer side (right side in FIG. 1) of an area facing a recording paper 100, corresponding to a range of movement of the carriage 2 in the scanning direction. The purge mechanism 6 includes a cap 40, a suction pump 41 connected to the cap 40, and a cap driving motor 42 for moving the cap 40 in the up-down direction (refer to FIG. 7). The cap 40 is driven in the up-down direction (direction perpendicular to the paper surface of FIG. 1) by the cap driving motor 42. When the cap 40 is moved upward in a state of the carriage 2 facing the cap 40, the plurality of nozzles 22 in the lower surface of the ink-jet head 3 are covered by the cap 40.

An inside of the cap 40 is depressurized by operating the suction pump 41 in a state of the plurality of nozzles 22 of the ink-jet head 3 covered by the cap 40. At this time, a suction purge in which the ink is sucked from the plurality of nozzles 22 is carried out. By the suction purge, dust and air bubbles or ink which has been thickened due to drying inside the ink-jet head 3 are discharged from the plurality of nozzles 22, and the jetting performance of the nozzle 22 in which the jetting defect has occurred is restored.

Figure 3:
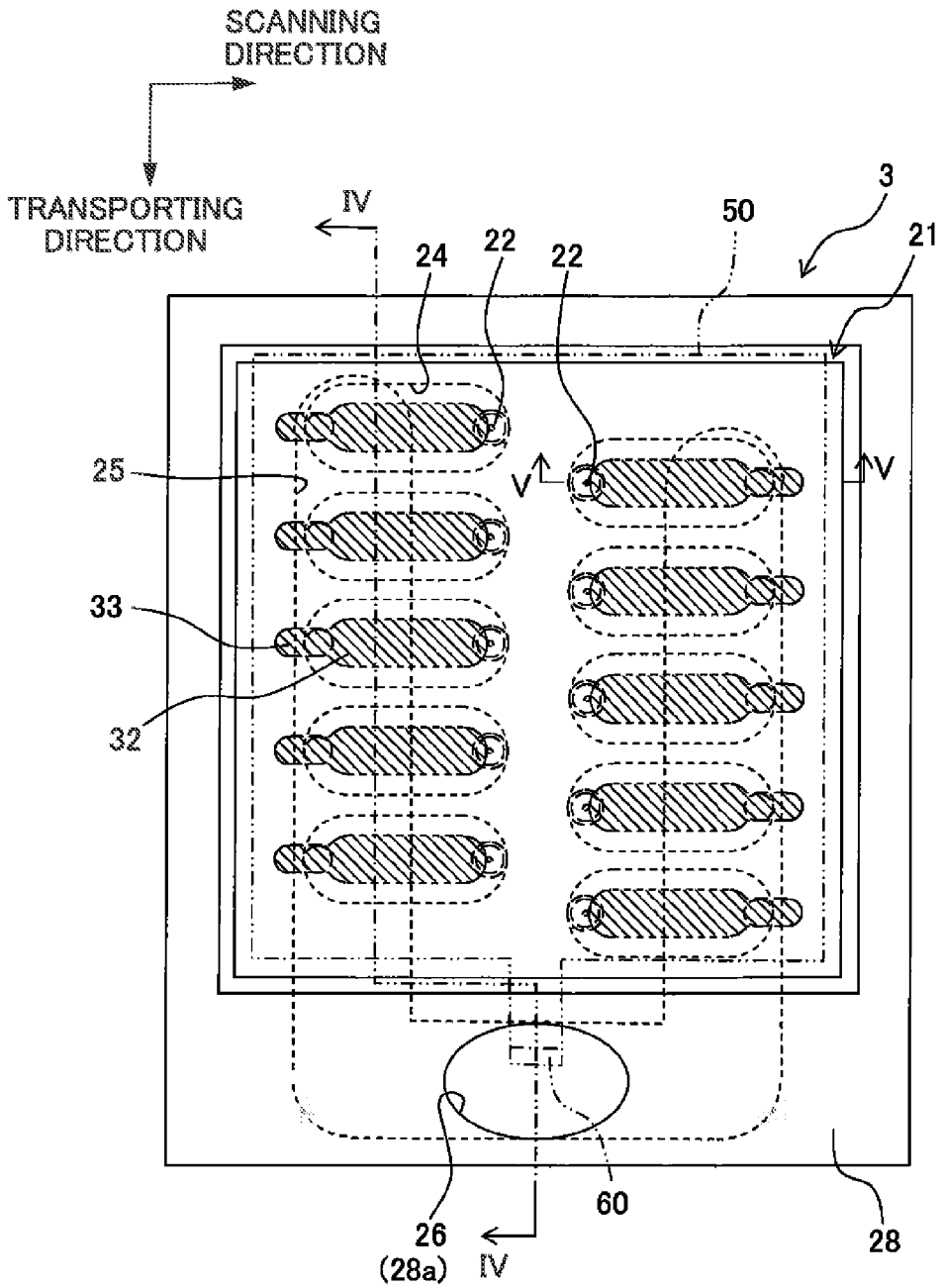
FIG. 3 is a plan view of the ink-jet head.
Figure 4:
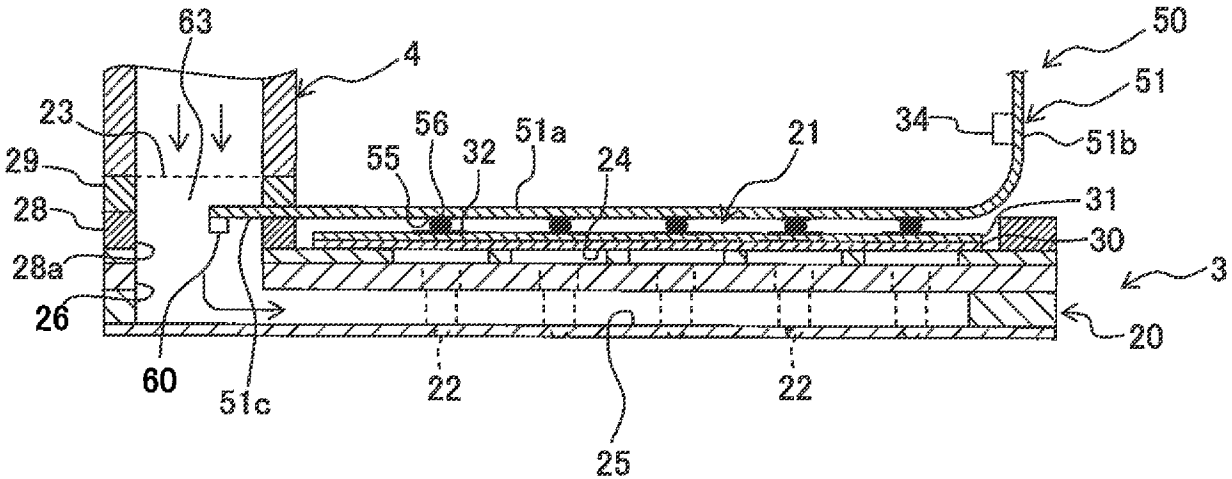
FIG. 4 is a cross-sectional view taken along a line IV-IV in FIG. 3.
Figure 5:
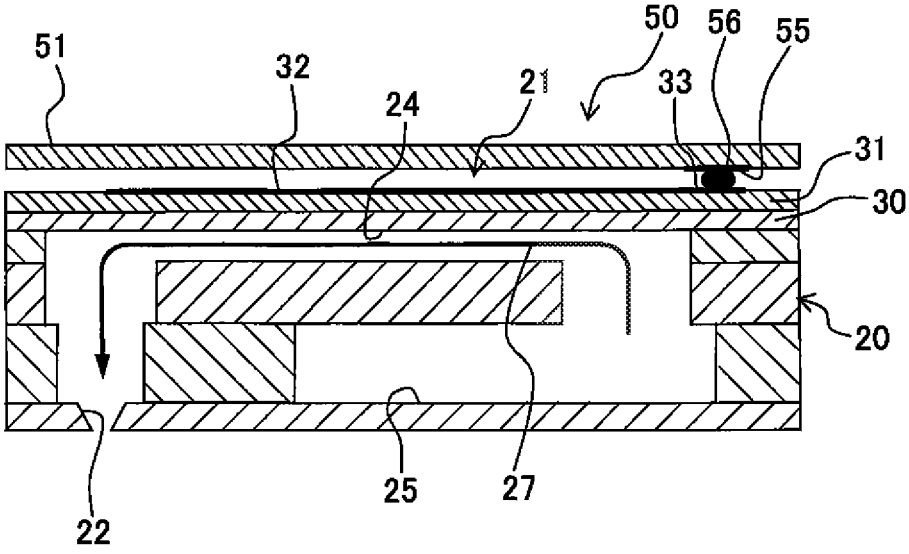
FIG. 5 is a cross-sectional view taken along a line V-V in FIG. 3.

Next, the structure of the ink-jet head 3 will be described below in detail. As shown in FIGS. 3, 4, and 5, the ink-jet head 3 includes a channel unit 20 in which channels such as a plurality of pressure chambers 24 and the plurality of nozzles 22 are formed, and a piezoelectric actuator 21 (energy conversion element) which is arranged on an upper surface of the channel unit 20.

As shown in FIGS. 4 and 5, the channel unit has a structure in which four plates are stacked. The plurality of nozzles 22 is formed in a lower surface of the channel unit 20. As shown in FIG. 3, the plurality of nozzles 22 are arranged in a row along the transporting direction so that two nozzle rows are formed. For simplifying the diagrams, one nozzle row includes five nozzles in FIG. 3 and FIG. 4. However, the present teaching is not restricted to a nozzle row of five nozzles 22, and each nozzle row may include at least one nozzle 22, and one nozzle row may include more than five nozzles 22. The plurality of pressure chambers 24 which communicate with the plurality of nozzles 22 is formed on the upper surface of the channel unit 20, the plurality of pressure chambers 24 is covered by the piezoelectric actuator 21 which will be described later. Moreover, the plurality of pressure chambers 24 is arranged in two rows corresponding to the plurality of nozzles 22.

Furthermore, an ink supply hole 26 which is extended in a direction of stacking of the plates (up-down direction), and which has opened on the upper surface of the channel unit 22 is formed in the channel unit 22. A reinforcing frame 28 in the form of a rectangular frame is joined to the upper surface of the channel unit 20, surrounding the piezoelectric actuator 21 which will be described later. A through hole 28*a* corresponding to the ink supply hole 26 is formed in the reinforcing frame. Moreover, the ink supply hole 26 which has opened on the upper surface of the channel unit 20 is connected to the sub tank 4 via the through hole 28*a* in the reinforcing frame 28 and a sealing member 29 in the form of a tube made of a material such as rubber. As shown in FIG. 4, a filter 23 which traps dust and air bubbles etc. in the ink is provided between the sealing member 29 and the sub tank 4.

Two manifolds 25 which are branched from a lower-end portion of the ink supply hole 26, and which are extended in the horizontal direction (transporting direction) are formed at an interior of the channel unit 20. Moreover, the plurality of pressure chambers 24 in one row of the pressure chambers 24 communicate commonly with one manifold 25 which is arranged at a lower side of the row of pressure chambers 24. A plurality of individual ink channels 27 which are branched from the manifold 25, and reach the nozzle 22 via the pressure chambers 24 are formed inside the channel unit 20. The ink which has flowed into the channel unit 20 from the ink supply hole 26 is supplied to the plurality of pressure chambers via two manifolds 25. Moreover, in each pressure chamber 24, due to a pressure being applied to the ink by the piezoelectric actuator 21 which will be described later, ink droplets are jetted from the nozzle 22 communicating with the pressure chamber 24.

As shown in FIGS. 4 and 5, the piezoelectric actuator 21 includes a vibration plate 30, a piezoelectric layer 31, and a plurality of individual electrodes 32. The vibration plate 30 is formed of a metallic material, and is joined to the upper surface of the channel unit 20 to cover all the pressure chambers 24. The piezoelectric layer 31 is arranged flatly to cover all the pressure chambers 24 on the upper surface of the vibration plate 30. The piezoelectric layer 31 is polarized in advance in a direction of thickness thereof. The plurality of individual electrodes 32 is formed in an area on an upper surface of the piezoelectric layer 31, overlapping the plurality of pressure chambers 24.

A plurality of connecting terminals 33 is drawn from the plurality of individual electrodes 32 up to an area not overlapping the corresponding pressure chamber 24. A flexible printed circuit (FPC) 50 on which a driver IC 34 is mounted is connected to the plurality of connecting terminals 33. Accordingly, the plurality of individual electrodes 32 is connected to the driver IC 34 via a drive wire 54 on the FPC 50. Moreover, the vibration plate 30 which is positioned at a lower side of the piezoelectric layer 31 is formed of a metallic material, and functions as a common electrode facing the plurality of individual electrodes 32 sandwiching the piezoelectric layer 31. The vibration plate 30 is connected to a ground wire of the driver IC 34 and is kept at a ground electric potential all the time.

The FPC 50 (cabling member) has a substrate 51 which is flexible and is formed of a synthetic resin material such as polyimide. The substrate 51 has a first portion 51*a* which is to be connected to the piezoelectric actuator 21 and a second portion 51*b* which is connected to the first portion 51*a*. As shown in FIG. 4, the first portion 51*a* of the substrate 51 is arranged at an upper side of the piezoelectric actuator 21 so that the first portion 51*a* covers the piezoelectric actuator 21. The second portion 51*b* of the substrate 51 is bent or curved upward from the first portion 51*a* and is connected to the control unit 7 which will be described later. The driver IC 34 (drive unit) is arranged at the second portion 51*b* on one surface of the substrate 51 (surface on the frontward side of the paper surface in FIG. 6). The driver IC 34 is connected to the control unit 7 via a plurality of input wires 53 formed on the substrate 51. A plurality of drive wires 54 which are connected to the driver IC 34 is formed at the first portion 51*a* on the one surface of the substrate 51. A plurality of contact points 55 is formed at the first portion 51*a* on the other surface of the substrate 51 (surface on a rearward side of the paper surface in FIG. 6). The plurality of contact points 55 is connected to the plurality of drive wires 54 respectively, via a through hole formed in the substrate 51. Moreover, as shown in FIGS. 4 and 5, the plurality of contact points 55 is electrically connected to the plurality of connecting terminals 33 of the piezoelectric actuator 21 by bumps 56 made of an electroconductive material.

The driver IC 34 generates a driving signal for driving the piezoelectric actuator 21 based on a command from the control unit 7. The generated driving signal is supplied from the driver IC 34 to the plurality of individual electrodes 32 of the piezoelectric actuator 21 via the plurality of contact points 55 and the plurality of drive wires 54 on the FPC 50.

In the aforementioned piezoelectric actuator 21, as the driving signal is supplied from the driver IC 34 to a certain individual electrode 32, an electric voltage is generated between the individual electrode 32 and the vibration plate 30 as the common electrode. Accordingly, an electric field in a direction of thickness of the piezoelectric layer 31 is generated in a portion of the piezoelectric layer 31, sandwiched between the individual electrode 32 and the vibration plate 30. Since a direction of polarization and a direction of the electric field in the piezoelectric layer 31 are parallel with each other, the piezoelectric layer 31 sandwiched between the two electrodes (the individual electrode and the vibration plate) contracts in a planar direction. When the piezoelectric layer 31 is deformed to contract, a portion of the vibration plate 30 facing the pressure chamber 24 is bent to form a projection toward the pressure chamber 24 (unimorph deformation). At this time, since a volume of the pressure chamber 24 is decreased, a jetting energy is applied to the ink at the interior of the pressure chamber 24, and droplets of ink are jetted from the nozzle 22 which communicates with the pressure chamber 24.

Figure 6:
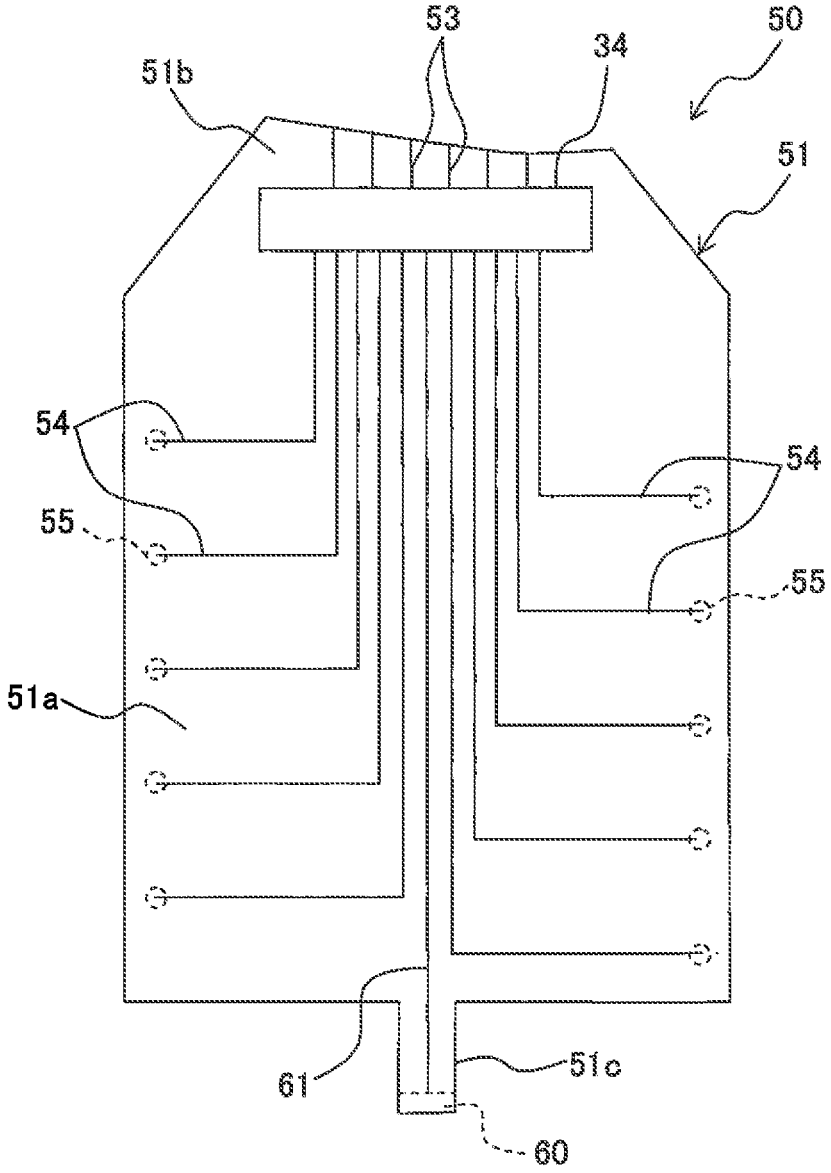
FIG. 6 is a plan view of an FPC (flexible printed circuit)

Furthermore, as shown in FIG. 6, a flow detecting sensor 60 which detects a flow of the ink in the ink channels inside the ink-jet head 3 is provided to the substrate 51 of the FPC 50. Concretely, a protruding portion 51*c* is formed at a center of a front-end portion of the first portion 51*a* of the substrate 51, and the flow detecting sensor 60 is arranged at the protruding portion 51*c* on a rear surface thereof (on the rearward side of the paper surface in FIG. 6). In other words, the flow detecting sensor 60 is provided to a portion of the substrate 51, on a side opposite to the driver IC 34 with respect to the first portion 51*a* on which the plurality of contact points 55 is arranged. Moreover, a signal output wire 61 connected to the flow detecting sensor 60 is formed on the first portion 51*a* of the substrate 51. In FIG. 6, two sets of drive wires 54 corresponding to two nozzle rows are arranged so that the two sets of the drive wires are divided to left and right, and the signal output wire 61 is arranged between the two sets of drive wires 54. In other words, the signal output wire 61 is arranged to pass almost the center of the FPC 50, in a width direction which is orthogonal to a longitudinal direction of the FPC 50 (direction in which the FPC 50 is extended), and almost the same number of drive wires 54 are arranged on both sides of the signal output wire 61 in the width direction. Since the signal output wire 61 and the drive wire 54 are arranged in such manner, it is possible to carry out wiring compactly while suppressing a width of the FPC 50.

In FIG. 6, the signal output wire 61 and the drive wire 54 are connected to the driver IC 34, and an arrangement is made such that a detection signal which has been output from the flow detecting sensor 60 is transmitted to the control unit 7 via the driver IC 34. However, the signal output wire 61 is not particularly required to pass through the driver IC 34, and the signal output wire 61 may be connected directly to the control section 7.

As shown in FIG. 4, the first portion 51*a* of the substrate 51 is extended almost parallel to the piezoelectric actuator 21, and the protruding portion 51*c* positioned at a front-end portion of the first portion 51*a* is inserted between the reinforcing frame 28 and the sealing member 29, and is inserted into the ink channel 63 between the channel unit 20 and the sub tank 4. In other words, the flow detecting sensor 60 which is provided on the protruding portion 51*c* is arranged inside the ink channel 63. Moreover, the flow detecting sensor 60 is installed on a side close to the nozzle 22 than the filter 23 (in other words, a downstream side in a direction of flow of ink).

The flow detecting sensor 60 detects the flow of the ink inside the ink channel 63 and outputs a detection signal related to an extent of the flow (in other words, a magnitude of flow velocity of ink). Since the flow detecting sensor 60 is arranged inside the ink channel 63, it is possible to detect directly the flow of the ink inside the ink channel 63, and the detection of flow is easy and assured. A type of the flow detecting sensor 60 is not necessarily of any particular type. For instance, it is possible to adopt a sensor or a gauge such as a strain gauge, a displacement gauge and a piezoelectric sensor. In this case, with a detecting member provided with a strain gauge or a piezoelectric sensor installed, a deformation of the detecting member inside the channel caused due to the flow of the ink (hydrodynamic pressure) inside the channel is converted to a voltage signal by a strain gauge or a piezoelectric sensor, and then the voltage signal is output. Or, as the flow detecting sensor 60, it is possible to adopt a thermistor. When electric power is supplied to operate the thermistor, heat is generated in the thermistor and is imparted to ink around the thermistor. A temperature of the ink around the thermistor increases due to the heat imparted. When the heat flows, the heat is susceptible to be diffused (spread) as compared to a case when the ink does not flow. In such manner, since a time variation of the rise in temperature of the ink reflects an extent (a degree) of the flow of ink, it is possible to detect the flow (flow-rate) of the ink by detecting a change in temperature of the ink by the thermistor. In this case, the change in temperature of the ink inside the ink channel 63 is converted to a voltage signal by the thermistor, and then the voltage signal is output. Further, as the flow detecting sensor 60, it is possible to adopt an acoustic detector including a microphone element for detecting a sound of flowing the ink. It is also possible to adopt a reflectometer for detecting a reflectance change of the ink due to the ink flow.

In a case in which the flow detecting sensor 60 is a sensor of a type which detects the flow of the ink by using a deformation of a detecting member, such as a strain gauge, a displacement gauge or a piezoelectric sensor, more the detecting member is susceptible to bending, higher is a detection sensitivity. Consequently, in a case in which the protruding portion 51*c* is a part of the substrate 51 which is flexible, the detecting member which is provided to the protruding member 51*c* is preferable from a point that the detecting member is deformed easily. Whereas, in a case of a sensor of a thermistor type, when the protruding portion 51*c* of the substrate 51 to which the thermistor is provided is displaced substantially due to the flow of the ink, there is a possibility that the change in temperature inside the ink channel 63 cannot be detected correctly. Therefore, in a case of a thermistor, for suppressing the displacement of the protruding member 51*c*, it is preferable that a stiffness of the protruding portion 51*c* is improved by increasing a thickness locally as compared to a thickness of the other portion of the substrate 51. For instance, it is possible to increase the thickness of the protruding portion 51*c* by applying a coating of a resin only on the protruding portion 51*c*.

As it will be described later, when droplets of ink are discharged from a certain nozzle 22 by the piezoelectric actuator 21, if jetting of droplets is normal, the ink inside the manifold 25 is consumed, and is replenished from an upstream side. Consequently, the flow of ink is supposed to be generated in the ink channel 63. Therefore, when droplets of ink are discharged from a certain nozzle 20, when the flow of ink is detected in the ink channel 63 by the flow detecting sensor 60, the jetting of ink from that nozzle 22 can be judged to be normal. Whereas, when the flow of ink is almost not detected, the jetting of ink from that nozzle can be judged to be defective. In the embodiment a 'jetting defect of the nozzle 22' does not include only a state of non-jetting in which the droplets of ink are not at all jetted from the nozzle 22, but also includes a state in which although the droplets of ink are jetted from the nozzle 22, the amount of droplets jetted is smaller as compared to an amount which is jetted in regular jetting.

Next, an electrical structure of the ink-jet printer 1 will be described below. The control unit 7 of the ink-jet printer 1 shown in FIG. 7 includes a microcomputer which includes a Central processing unit (CPU), a Read Only Memory (ROM) in which various computer programs and data for controlling an overall operation of the ink-jet printer 1 are stored, and a Random Access Memory (RAM) which temporarily stores data to be processed by the CPU, various arithmetic circuits for controlling each structure (component) of the ink-jet printer 1, and a storage memory such as a flash memory in which various data is stored.

A PC (personal computer) 70 which is an external equipment, and an operation panel 71 which includes a display and operating buttons are connected to the control unit 7. Based on data related to an image etc. which has been input from the PC 70, the control unit 7 controls the transporting motor 14 of the transporting mechanism 5, the carriage driving motor 19, and the driver IC 34 of the ink-jet head 3 to record the image on a recording paper P. Moreover, the control unit 7 carries out a suction purge of the ink-jet head 3 by controlling the suction pump 41 and the cap driving motor 42 of the purge mechanism 6.

Furthermore, based on the detection signal related to the flow inside the ink channel 63 which has been output from the flow detecting sensor 60, the control unit 7 detects whether or not there is a jetting defect in the nozzle 22. In other words, the control unit 7 according to the embodiment, functions as a jetting defect detecting mechanism according to the present teaching.

The detection of the jetting defect in the nozzle 20 will be described below in detail. A timing of detecting the jetting defect is not restricted in particular, and detection can be carried out at any arbitrary timing. However, it is effective to carry out detection when a possibility of occurrence of jetting defect is considered to be high. For instance, in a case in which a recording operation of the ink-jet printer 1 in which the ink is jetted from the ink-jet head 3 has not been carried out for a while, a possibility that mixing of air bubbles or drying of ink has occurred is high. Therefore, the detection of jetting defect may be carried out at the time of putting electric power supply of the ink-jet printer ON, or in a case when a certain period of time has elapsed since the previous recording operation. Or the detection may be started when a command for carrying out detection of jetting defect has been input by a user from the PC 70 or from the operation panel 71.

The detection of jetting defect is to be carried out one after another for all the nozzles 22. In a case of detecting whether or not there is a jetting defect in a certain nozzle 22, the control unit 7 controls the driver IC 34 to output a driving signal for driving the nozzle 22, which is to be subjected to checking, to the piezoelectric actuator 21. Accordingly, the piezoelectric actuator 21 applies a jetting energy to the ink in the pressure chamber 24 which communicates with the nozzle 22 to be subjected to checking. At this time, the control section 7 outputs only a driving signal which drives the nozzle 22 to be subjected to checking, and controls the driver IC 34 such that a driving signal for the other nozzles 22 is not output.

Moreover, the control section 7 sets a jetting amount of one nozzle 22 to be subjected to checking to a value not smaller than a certain value. Accordingly, when the ink droplets are jetted normally, a flow velocity of ink not lower than a predetermined value is generated, and it is possible to detect the flow of ink in the ink channel 63 assuredly by the flow detecting sensor 60.

It is possible to set the jetting amount of the nozzle 2 as described below.

volume of droplets jetted from the nozzle 22 in one jetting operation: 30 pl drive frequency (supply frequency of driving signal of the driver IC 34): 20 kHz jetting time: 0.2 seconds In this case, the total jetting amount of droplets jetted from one nozzle 22 becomes 0.12 μl.

In the abovementioned example, the jetting amount per second is 0.6 μl/s (=0.6 $mm^3$/s). Moreover, when a diameter of a cross-section of the ink channel 63 is 3 mm, a cross-sectional area becomes 7.1 $mm^2$. Consequently, the flow velocity of the ink which flows through the ink channel 63 becomes 0.6/7.1=0.085 mm/s.

In a case in which the flow velocity of the ink which has been detected by the flow detecting sensor 60 is not less than the predetermined value, the control section 7 makes a judgment that the jetting of the nozzle 22 subjected to checking is normal. Whereas, in a case in which the flow velocity of the ink which has been detected by the flow detecting sensor 60 is less than the predetermined value, assuming that almost no ink has been consumed, the control unit 7 makes a judgment that a jetting defect has occurred in the nozzle 22 subjected to checking.

Incidentally, when driving (supply of the driving signal) of the piezoelectric actuator 21 by the driver IC 34 and judgment of the jetting defect of the nozzle 22 based on the detection signal of the flow detecting sensor 60 are carried out simultaneously, the detection signal which has been output from the flow detecting sensor 60 is affected by noise caused due to the driving signal, and there is a possibility that an incorrect judgment is made. Therefore, it is preferable that the supply of the driving signal to the piezoelectric actuator 21 by the drive wire 54, and transmission of the detection signal by the signal output wire 61 from the flow detecting sensor 60 are not carried out simultaneously. For this, the judgment of jetting defect of the nozzle 22 is to start after the supply of the driving signal to the piezoelectric actuator 21 is terminated. As the supply of the driving signal to the piezoelectric actuator 21 is terminated, the jetting of droplets of ink from the nozzle 20 is also terminated. However, since the flow of ink due to inertia has remained inside the ink channel 63 even after the droplets are jetted, it sufficiently possible to detect the flow of ink inside the ink channel 63 even after the jetting of ink droplets has been terminated.

As checking of one nozzle 22 is terminated, checking is carried out one after another similarly for the other nozzles 22. In a case in which the jetting defect is detected to have occurred for some nozzles 22, a recovery (restoration) operation of eliminating non-jetting of these nozzles 22 is to be carried out. Concretely, the jetting defect of the nozzles 22 is to be eliminated by making the purge mechanism 6 carry out suction purge. Moreover, since the control unit 7 is capable of identifying the nozzle 22 in which the jetting defect has occurred, the control unit 7 can eliminate the jetting defect individually (separately) by carrying out flushing of the nozzle 22 in which the jetting defect has been identified. Moreover, it is possible to find out the number of nozzles 22 in which the jetting defect has occurred. Therefore, a power of suction purge (suction force) of the purge mechanism 6 can be changed based on the number of nozzles 22 in which the jetting defect has occurred. For example, when the number of nozzles 22 in which the jetting defect has occurred is not more than half of the total number of nozzles 22, the normal suction purge can be carried out, and when the number of nozzles 22 in which the jetting defect has occurred is more than half of the total number of nozzles 22, a strong suction purge with a high suction force can be carried out.

As it has been described above, in the embodiment, the flow detecting sensor 60 which detects the flow of ink inside the ink channel 63, and the signal output wire 61 thereof are arranged on the FPC 50 which is for supplying the driving signal from the driver IC 34 to the piezoelectric actuator 21. In other words, since the cabling member is used in common by the piezoelectric actuator 21 and the flow detecting sensor 60, it is not necessary to provide a dedicated cabling member for drawing around the flow detecting sensor 60.

In the embodiment, the cabling member on which the flow detecting sensor 60 and the signal output wire 61 are formed is the FPC 50 having the flexible substrate 51. Therefore, it is possible to further draw round the FPC 50 from a position at which the FPC 50 is connected to the piezoelectric actuator 21, and to arrange the flow detecting sensor 60 irrespective of the position of the piezoelectric actuator 21. In other words, a degree of freedom of arranging the flow detecting sensor 60 can be increased.

In the embodiment, the flow detecting sensor 60 and the driver IC 34 are provided to the same FPC 50. Here, at the time of driving the piezoelectric actuator 21, substantial heat is generated in the driver IC 34. Moreover, as the heat generated in the driver IC 34 is transmitted to the flow detecting sensor 60 via the substrate 51 of the FPC 50, there is a possibility of degradation of a detection sensitivity of the flow detecting sensor 60. For instance, in a strain gauge or in a piezoelectric sensor, as the temperature of the detecting member which is deformed by the flow of ink, changes, a degree of deformation corresponding to the flow of ink changes. Moreover, in a case of a thermistor, there is a possibility that the change in the temperature of the ink channel 63 cannot be detected correctly. For this point (reason), as shown in FIG. 3 and FIG. 4, the flow detecting sensor 60 is arranged on the substrate 51 at an opposite side of the driver IC 34 with respect to the first portion 51*a* on which the plurality of contact points 55 connected to the piezoelectric actuator 21 are arranged. Consequently, the heat generated in the driver IC 34 is hardly transmitted to the flow detecting sensor 60.

As shown in FIG. 4, in the embodiment, the flow detecting sensor 60 is arranged at a downstream side of the filter 23. In other words, the flow detecting sensor 60 detects the flow of ink at a downstream-side portion of the filter 23. In channels at an upstream side of the filter 23, due to a flow resistance of the filter 23, and existence of dust and air bubbles etc. it is difficult to detect the flow of ink accurately. For instance, it is not possible to detect the resistance inside the ink channel in a case in which the amount of consumption of ink is small, or inversely, there is a possibility of an incorrect detection such as detecting the flow incorrectly due to dust and air bubbles etc. at the upstream side of the filter 23 in spite of the ink not being consumed. Moreover, there is a possibility of incapability of detection due to the dust and air bubbles trapped by the filter 23 adhered to the flow detecting sensor 60. From the abovementioned point of view, it is preferable that the flow detecting sensor 60 is provided at a downstream side of the filter 23.

Next, modified embodiments in which various changes are made in the embodiment will be described below. However, same reference numerals will be assigned to components which have similar structure as in the embodiment, and the description of such components will be omitted.

As it has been mentioned earlier, the cabling member to which the flow detecting sensor 60 is to be provided being the FPC 50 having a flexibility, it is possible to arrange the flow detecting sensor 60 freely irrespective of the position of the piezoelectric actuator 21 by further drawing around the FPC 50 from the position at which the FPC 50 is connected to the piezoelectric actuator 21. Therefore, it is possible to arrange the flow detecting sensor 60 at a position which is favorable for detecting the flow of ink.

Figure 8:
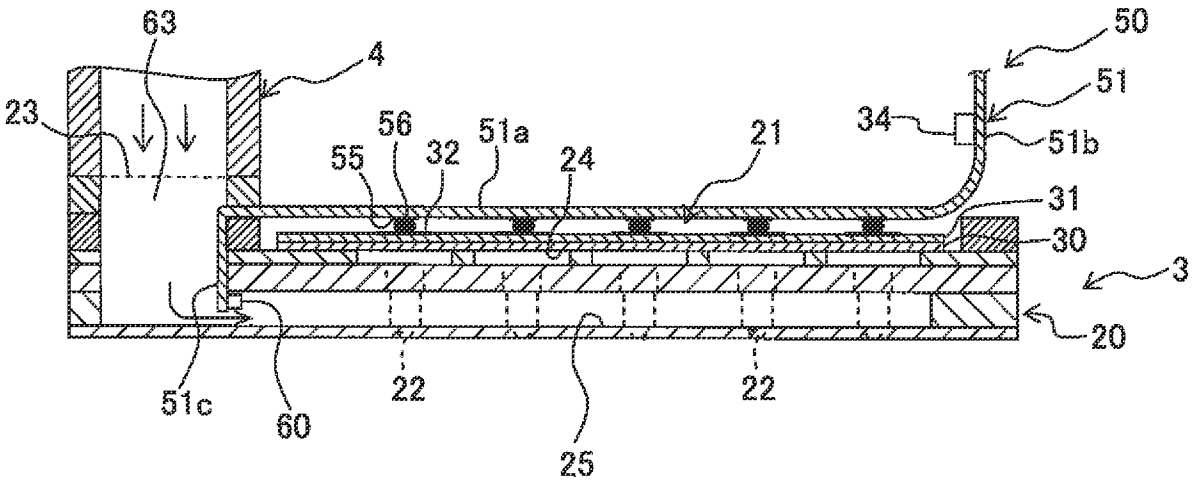
FIG. 8 is a cross-sectional view corresponding to FIG. 4, of an ink-jet head according to a modified embodiment.

From a point of view of detecting the flow of ink assuredly by the flow detecting sensor 60, it is preferable to provide the flow detecting sensor 60 at a location where a cross-sectional area of the channel is small, and the flow is rapid, inside the ink channel which is to be connected to the nozzle 22. For this point (reason), as it is evident from FIG. 8, at a position of branching to the two manifolds 25 from the ink supply hole 26, the channel cross-sectional area of the ink channel is smaller than the channel cross-sectional area of the ink channel at a position between the sub tank 4 and the ink-jet head 3 in the embodiment. Therefore, as shown in FIG. 8, the flow detecting sensor 60 which has been provided to the protruding portion 51*c* upon bending the protruding portion 51*c* of the substrate 51 downward may be installed at a connecting position of the ink supply hole 26 and the manifold 25. Or, furthermore, the flow detecting sensor 60 may be installed inside the manifold 25 by the protruding portion 51*c* being inserted into the manifold 25.

From a point of view of connecting the signal output wire 61 of the flow detecting sensor 60 to the control unit 7 by using the FPC 50 for the piezoelectric actuator 21, at least the signal output wire 61 may be arranged on the FPC 50. In other words, the flow detecting sensor 60 may not be arranged on the FPC 50. In an example in FIG. 9, since the flow detecting sensor 60 is installed on the reinforcing frame 28 via a supporting member 80, the flow detecting sensor 60 is arranged inside the ink channel 63. Moreover, an output terminal 60*a* of the flow detecting sensor 60 is drawn up to an outside of the ink channel 63, and the output terminal 60*a* is connected to the signal output wire 61 (not shown in FIG. 9) which is formed on the FPC 50.

Figure 9:
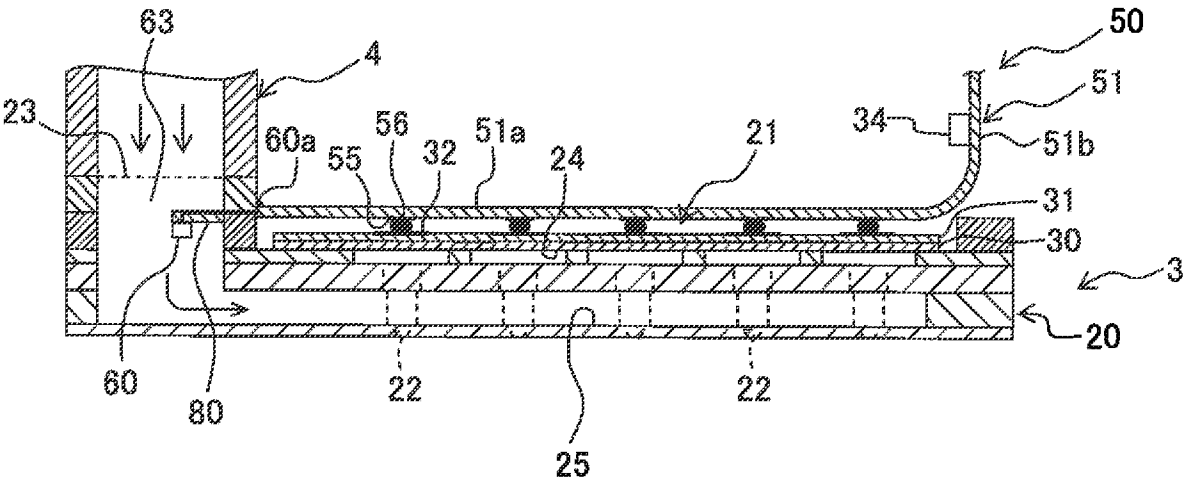
FIG. 9 is a cross-sectional view corresponding to FIG. 4, of an ink-jet head according to another modified embodiment.

As in FIG. 9, in a case in which the flow detecting sensor 60 is provided to the FPC 50, when an external force acts on the FPC 50, there is a possibility that a connection between the output terminal 60*a* of the flow detecting sensor 60 and the signal output wire 61 on a side of the FPC 50 is cut. Consequently, from a point of view of reliability of the connection between the flow detecting sensor 60 and the signal output wire 61, it is advantageous that the flow detecting sensor 60 is provided to the signal output wire 61 and also to the FPC 50 as in the arrangement in the embodiment shown in FIG. 4. However, in a case in which a portion of the FPC 50 to which the velocity detecting sensor 60 is provided is inserted into the ink channel 63 as in the arrangement in the embodiment shown in FIG. 4, it is necessary to seal assuredly such that the ink does not leak from an insertion portion. For this reason, in an arrangement shown in FIG. 9, since it is not necessary to insert the substrate 51 of the FPC 50 into the ink channel 63, a sealing performance of that high degree is not sought.

Figure 10A:
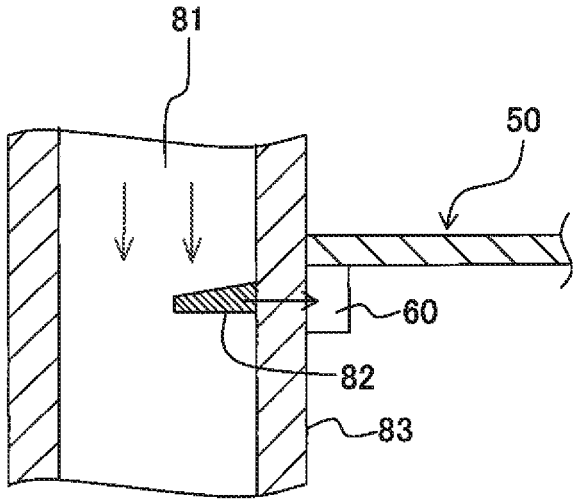
FIGS. 10A and 10B are diagrams showing an example of a structure in which, a liquid detecting sensor is installed outside an ink channel, according to still another modified embodiment.

In the present teaching, the flow detecting sensor 60 which outputs the detection signal may not be installed necessarily inside the ink channel, and may be installed outside the ink channel. For instance, in a modified embodiment in FIG. 10A, a stress-luminescent member 82 which emits light by a stress which is generated due to a hydrodynamic pressure of the ink is provided inside an ink channel 81. Whereas, the flow detecting sensor 60 having a light receiving element is installed on an outer side of a wall portion 83 which forms the ink channel 81. The wall portion 83 which forms the ink channel 81 is formed of a transparent material. In this modified embodiment, when the flow of ink is generated inside the ink channel 81, as the stress-luminescent member 82 emits light, light of the stress-luminescent member 82 upon passing through the wall portion 83, is received by the light receiving element 60 of the flow detecting sensor 60, and a detection signal is output from the light receiving element. For the description of the stress-luminescent member 82 which is omitted here, refer to a cited disclosure of Japanese Patent Application Laid-open Publication No. 2009-162600 by the same applicant as of the present application, and the disclosure of which is incorporated herein by reference in its entirety.

Figure 10B:
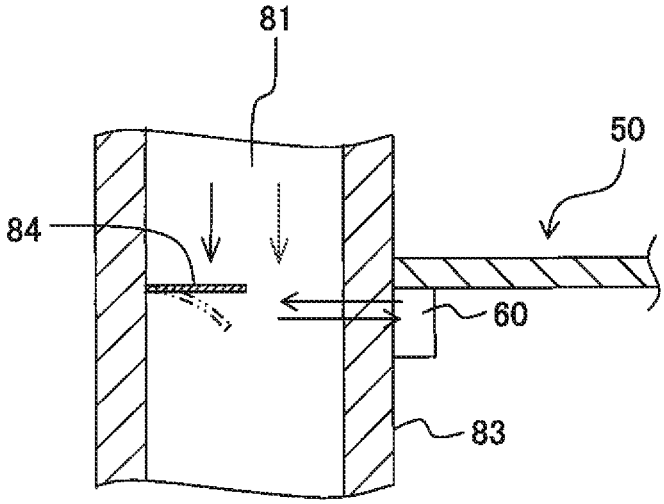

Moreover, in a modified embodiment of FIG. 10B, a thin plate member 84 which is deformed by the flow of ink is provided inside the ink channel 81. The thin plate member 84 is formed of a light shielding material. Moreover, the flow detecting sensor 60 which includes a light emitting element and a light receiving element is installed at an outer side of the wall portion 83 which forms the ink channel 81. Even in the present modified embodiment, the wall portion 83 which forms the ink channel 81 is formed of a transparent (translucent) material. In the present modified embodiment, when the flow of ink is generated inside the ink channel 81, the thin plate member 84 is deformed to a state indicated by alternate long and two short dashes lines from a state indicated by solid lines. At this time, light which has been irradiated inside the ink channel 81 from the light emitting element of the flow detecting sensor 60 being received by the light receiving element upon being reflected at the thin plate member 84, it is possible to detect the flow of ink inside the ink channel 81.

Figure 12:
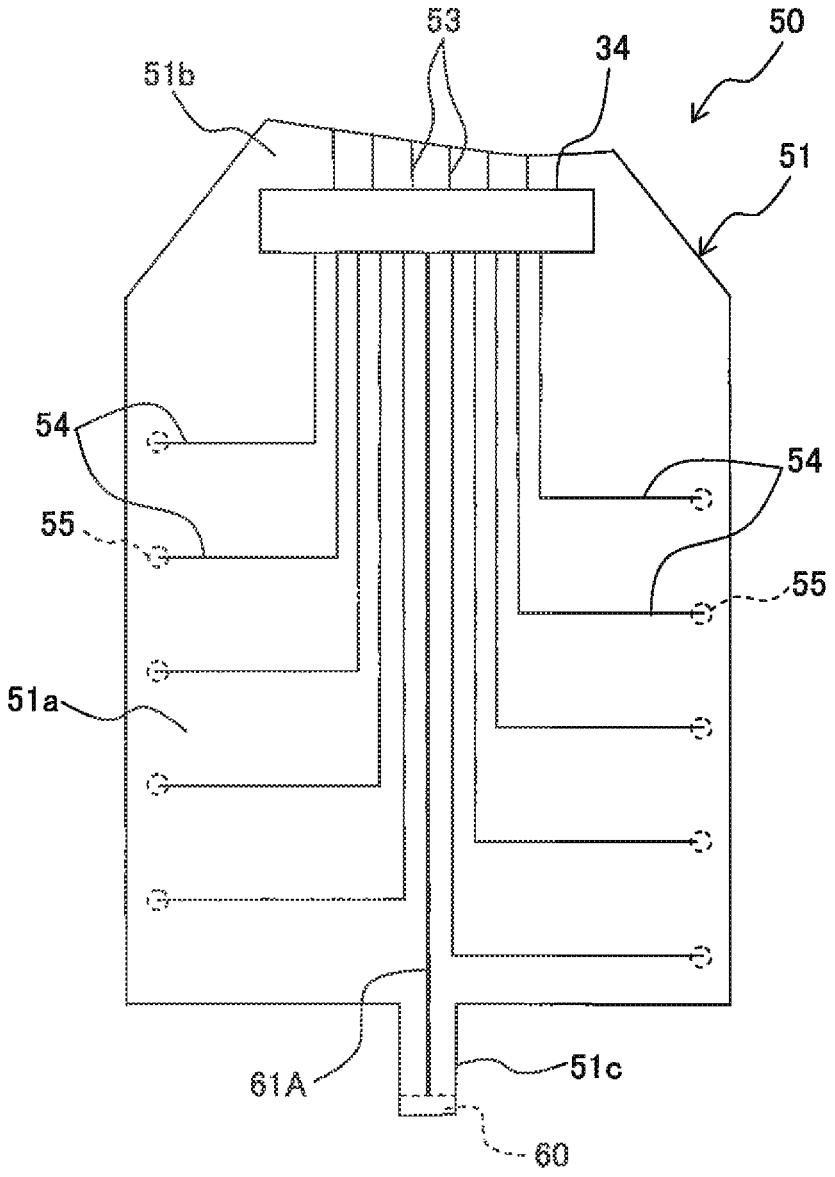
FIG. 12 is a plan view of an FPC having an optical wave guide.

In the embodiment described above, the signal output wire 61 from the flow detecting sensor 60 is an electric wire (a metallic wire) which transmits an electric signal. However, the present teaching is not restricted to such an arrangement. For instance, as shown in FIG. 12, an optical signal line 61A such as an optical fiber (optical wave guide) may be used as a signal output line from the flow detecting sensor 60. In this case, even in a case in which the driving signal is to be sent to the FPC 50, there is no possibility of noise being picked up by the optical signal line 61A. As it has been mentioned above, in a case of using a stress-luminescent member as the flow detecting sensor 60, light may be transmitted from the stress-luminescent member to the optical signal line 61A, and a light receiving element may be arranged at an end portion thereof. By making such an arrangement, it is possible to improve a degree of freedom of arrangement of the light receiving element.

In the embodiment, droplets of ink are jetted by each nozzle 22, and by detecting the flow inside the ink channel at this time by the flow detecting sensor 60, a judgment of whether or not there is a jetting defect in the plurality of nozzles 22 has been made individually (for each nozzle 22). However, in a case of carrying out restoration (recovery) of jetting performance of the plurality of nozzles 22 at a time by suction purge by the purge mechanism 6, it is not necessary to keep track of jetting defect of the plurality of nozzles 22 individually. In other words, it is sufficient that a judgment of as to whether there is a jetting defect in some of the plurality of nozzles 22 or as to whether the jetting of all the plurality of nozzles 22 is normal, can be made. In such a case, droplets of ink may be made to be jetted from the plurality of nozzles, and the flow of ink inside the ink channel at that time may be detected by the flow detecting sensor 60.

The embodiment is an example in which a detection result of the flow detecting sensor 60 is used for detecting the jetting defect of the nozzle 22. However, it is also possible to use the detection result of the flow detecting sensor 60 for a purpose other than detecting the jetting defect.

Figure 11:
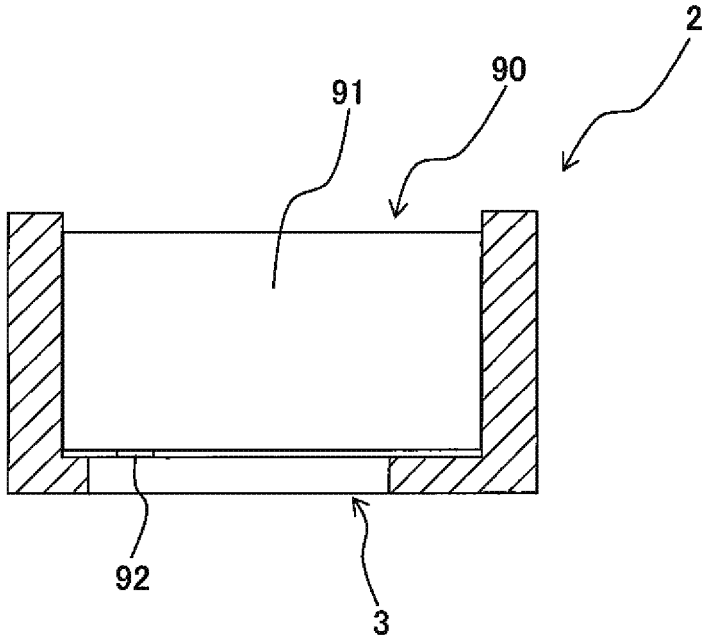
FIG. 11 is a cross-sectional view of a carriage according to still another modified embodiment.

An example for using detection of ink remained inside the ink-jet head 3 will be described below. The carriage 2 shown in FIG. 11 includes the ink-jet head 3 and a cartridge holder 90. An ink cartridge (liquid storage body) 91 which stores an ink is removably installed on the cartridge holder 90. The ink cartridge 91 which has been installed on the cartridge holder 90 is connected to the ink supply hole 26 (refer to FIG. 3 and FIG. 4) of the ink-jet head 3 by a connecting portion 92.

In the abovementioned modified embodiment, when the flow detecting sensor 60 is installed inside the connecting portion 92, the flow detecting sensor 60 detect the flow of ink which is supplied from the ink cartridge 91 to the ink-jet head 3. Here, when the ink inside the ink cartridge 91 is exhausted, even when the droplets of ink are jetted from the nozzle 22 and the ink is consumed, the ink is not supplied any more from an upstream side, and no flow ink is generated inside the connecting portion 92. Therefore, the control unit 7 is capable of detecting whether or not there is ink in the ink cartridge 91, from a detection signal of the flow detecting sensor 60. In the present modified embodiment, the control unit 7 functions as a remainder detecting mechanism according to the present teaching. Note that when the ink inside the ink cartridge 91 is exhausted, no flow ink is generated inside the connecting portion 92 for all nozzles. On the other hand, when the ink inside the ink cartridge 91 is not exhausted but a jetting defect occurs in a certain nozzle, then no flow ink is generated inside the connecting portion 92 only for the certain nozzle.

The cabling member on which the drive wire 54 for the actuator and the signal output wire 61 of the flow detecting sensor 60 are to be formed may be a rigid substrate which almost does not bend, and not a flexible substrate. Moreover, the driver IC 34 which drives the actuator is not necessarily required to be provided to the cabling member. For instance, the driver IC 34 may be provided to the control unit 7 to which the cabling member is to be connected.

As it has been understood from the abovementioned embodiment and modified embodiments, the flow detecting sensor 60 may be provided to the printer 1, at any position in the ink channel including the nozzle 22. For instance, the flow detecting sensor 60 may be provided at one of the locations such the individual ink channel 27 (FIG. 5), the manifold 25 (FIG. 3, FIG. 4, and FIG. 5), or the ink supply hole 26 (FIG. 3 and FIG. 4), provided that the flow detecting sensor 60 is inside the ink-jet head 3. Moreover, the flow detecting sensor 60 may be provided to the tube 15 and the sub tank 4 (refer to FIG. 1) on the upstream side of the ink-jet head 3. Furthermore, the flow detecting sensor 60 may be provided inside the ink cartridge. In other words, according to the arrangement in FIG. 1, all ink channels inside the ink-jet head 3, the sub tank 4, the tube 15, and the ink cartridge correspond to a 'liquid channel' according to the present teaching.

The embodiment and the modified embodiments described above are examples in which the present teaching is applied to an ink-jet printer which is a type of a liquid droplet jetting apparatus. However, the application of the present teaching is not restricted to the ink-jet printer. The present teaching is also applicable to liquid droplet jetting apparatuses which are used in other fields such as, an apparatus which forms various electroconductive patterns by jetting an electroconductive material in a liquid form on to a substrate.

What is claimed is:

1. A liquid droplet jetting apparatus configured to jet liquid droplets onto an object, comprising:

a channel member in which a nozzle for jetting the liquid droplets and a liquid channel communicating with the nozzle are formed;

an energy conversion element which is configured to apply a jetting energy to the liquid in the nozzle;

a drive unit which is configured to supply a driving signal to the energy conversion element;

a flow detecting sensor which is configured to detect a liquid flow inside the liquid channel; and a cabling member which includes a drive line connected to the energy conversion element, and a signal output line connected to the flow detecting sensor to transmit a detection signal corresponding to the liquid flow inside the liquid channel output from the flow detecting sensor.

2. The liquid droplet jetting apparatus according to claim 1, wherein the cabling member has a flexible substrate, and the drive line and the signal output line are formed on the flexible substrate.

3. The liquid droplet jetting apparatus according to claim 1, wherein the flow detecting sensor is arranged inside the liquid channel.

4. The liquid droplet jetting apparatus according to claim 1, wherein the flow detecting sensor is arranged on the cabling member.

5. The liquid droplet jetting apparatus according to claim 4, wherein the drive unit is arranged on the cabling member, and the flow detecting sensor is arranged on the cabling member, at an opposite side of the drive unit, with respect to a connecting portion with the energy conversion element.

6. The liquid droplet jetting apparatus according to claim 4, wherein the signal output line connected to the flow detecting sensor is wired to pass a central portion in a width direction orthogonal to a direction in which the cabling member is extended, and the drive line includes a plurality of drive lines and the drive lines are wired to both sides in the width direction of the signal output line.

7. The liquid droplet jetting apparatus according to claim 1, wherein the signal output line is an optical-wave guide configured to transmit an optical signal.

8. The liquid droplet jetting apparatus according to claim 1, wherein a filter is installed in the liquid channel, and the flow detecting sensor is located between the filter and the nozzle so that the flow detecting sensor detects a liquid flow in a portion of the liquid channel, toward a nozzle side of the filter.

9. The liquid droplet jetting apparatus according to claim 1, further comprising:

a jetting defect detecting mechanism which is configured to detect whether or not there is a jetting defect in the nozzle, based on the detection signal output from the flow detecting sensor, under a condition that a jetting energy of the liquid inside the nozzle is applied by the energy conversion element upon the driving signal being supplied to the energy conversion element from the drive unit.

10. The liquid droplet jetting apparatus according to claim 9, wherein the jetting defect detecting mechanism is configured to make a judgment of whether or not there is a jetting detect in the nozzle, based on the detection signal from the flow detecting sensor, after supply of the driving signal to the energy conversion element from the drive unit is terminated.

11. The liquid droplet jetting apparatus according to claim 1, further comprising:

a remainder detecting mechanism which is configured to detect whether or not there is a liquid inside a liquid storage body which is located in the liquid channel and which is configured to store the liquid.

12. The liquid droplet jetting apparatus according to claim 1, wherein the flow detecting sensor includes a thermistor which is configured to measure a temperature of the liquid inside the liquid channel.

13. The liquid droplet jetting apparatus according to claim 1, wherein the flow detecting sensor includes a stress-luminescent member having a deforming portion which is deformed by a flow of liquid inside the liquid channel, and a stress-luminescent portion which is configured to emit light upon being subjected to a stress under a condition that the deforming portion has undergone deformation.

* * * * *